United States Patent [19]

Flaherty

[11] Patent Number: 4,852,692

[45] Date of Patent: Aug. 1, 1989

[54] ROOFING SAFETY DEVICE

[75] Inventor: Brian J. Flaherty, Tustin, Calif.

[73] Assignee: Davey Roofing, Inc., Irvine, Calif.

[21] Appl. No.: 213,772

[22] Filed: Jun. 30, 1988

[51] Int. Cl.[4] ..... A62B 35/00

[52] U.S. Cl. ..... 182/231; 182/5; 182/236; 248/237; 248/536; 248/539

[58] Field of Search ..... 182/3, 5–7, 182/231, 236; 248/237, 536, 539

[56] References Cited

U.S. PATENT DOCUMENTS

| | | | |
|---|---|---|---|
| 1,661,930 | 3/1928 | Dietrich | 248/536 |
| 2,845,243 | 7/1958 | Mowers | 248/536 |
| 3,022,855 | 2/1962 | Lewis | 182/3 |
| 4,171,032 | 10/1979 | Woolslayer | 182/3 |
| 4,607,724 | 8/1986 | Hillberg | 182/3 |

FOREIGN PATENT DOCUMENTS

| | | | |
|---|---|---|---|
| 599016 | 10/1959 | Italy | 182/3 |
| 2134065 | 10/1984 | United Kingdom | 182/3 |

*Primary Examiner*—Reinaldo P. Machado

*Attorney, Agent, or Firm*—Knobbe, Martens Olson & Bear

[57] ABSTRACT

A roofing safety device, adapted to be used in connection with substantially all roof configurations comprises an upright support, adapted to be secured to the roof of a building, having at least one self-braking mechanism and cable assembly attached thereto. Disposed at the free end of the cable is a fastening device which may be secured to one of a plurality of heavy rings secured to a belt. The plurality of rings provided on the belt enables the worker to attach the cable of the self-braking mechanism to either side of his body, thereby allowing the worker to perform his task on the roof without being chafed by the cable. A pair of stabilizing struts, each having a rectangular foot at the distal ends thereof which are rotatable about a pair of orthogonal axes enables the device to conform to substantially any rooftop configuration. The ability of the safety device to be used in connection with virtually all rooftops, combined with the non-irritating manner in which the device may be secured to the worker increases the likelihood that the device will be used habitually, so as to reduce the number of roofing injuries and deaths.

7 Claims, 2 Drawing Sheets

Fig. 1
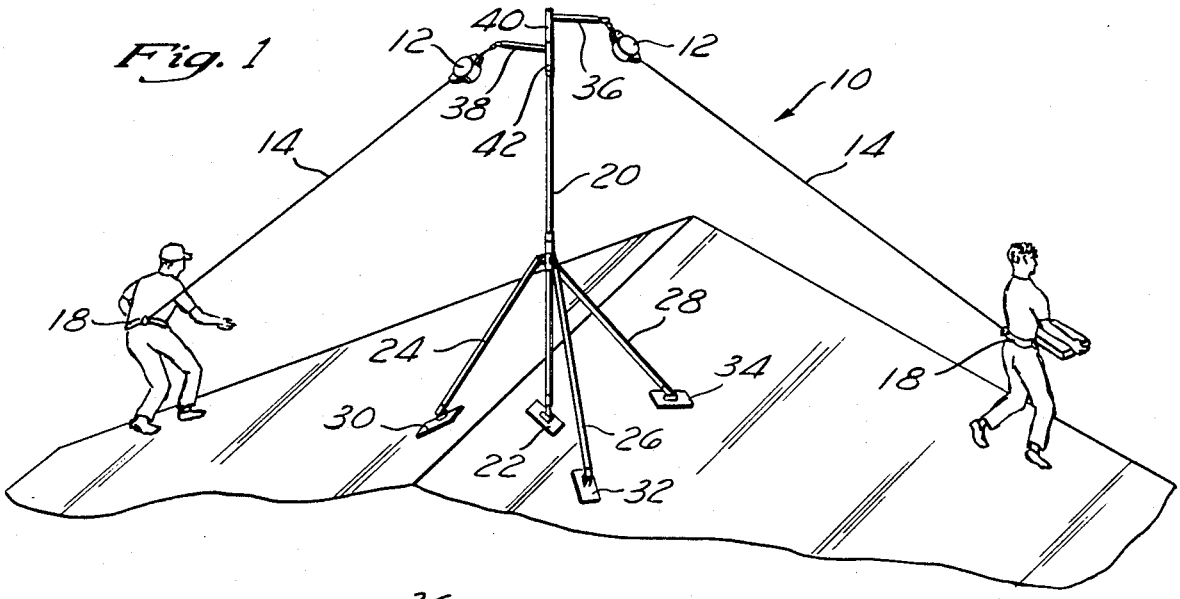
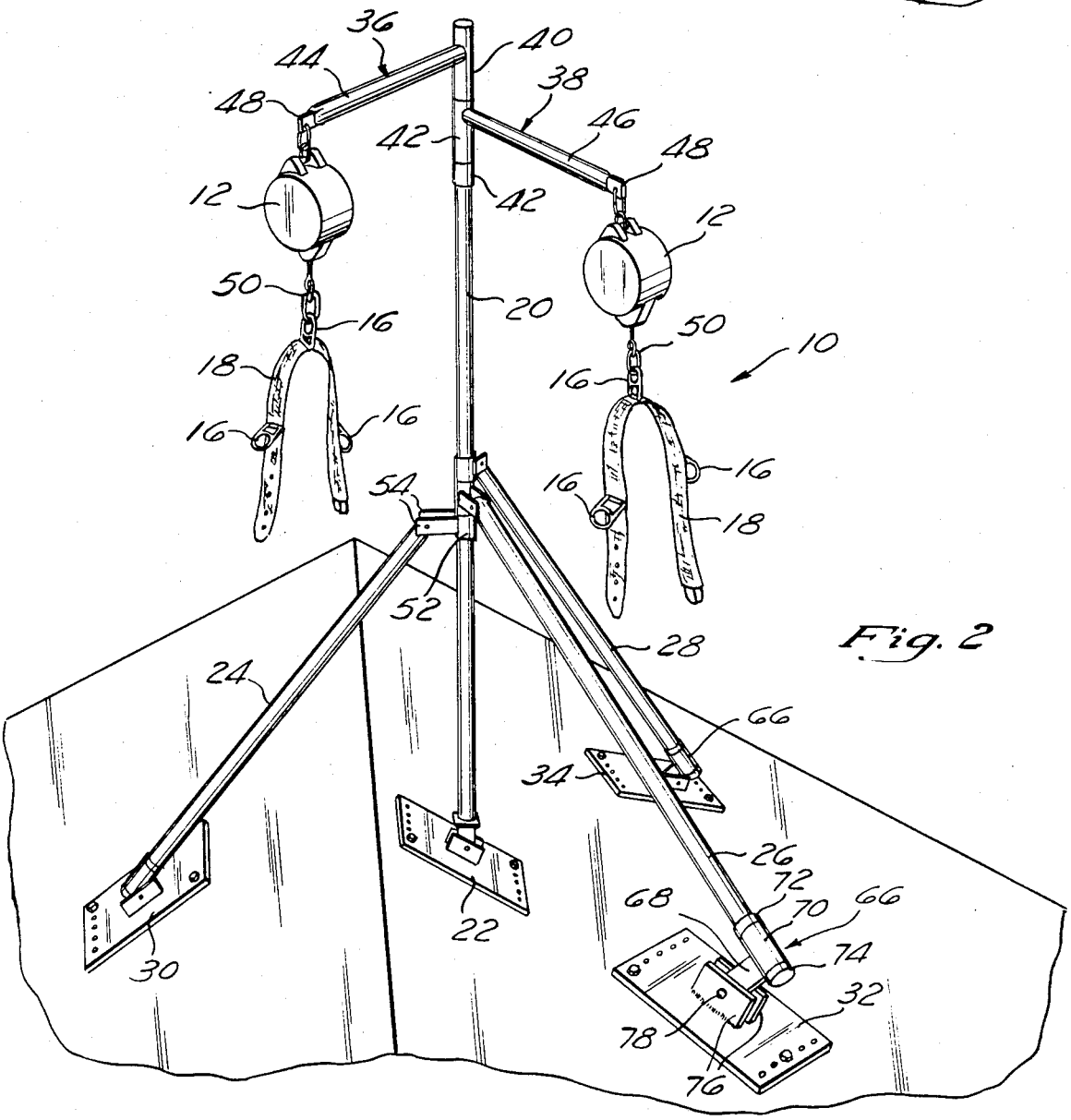
Fig. 2

Fig. 3
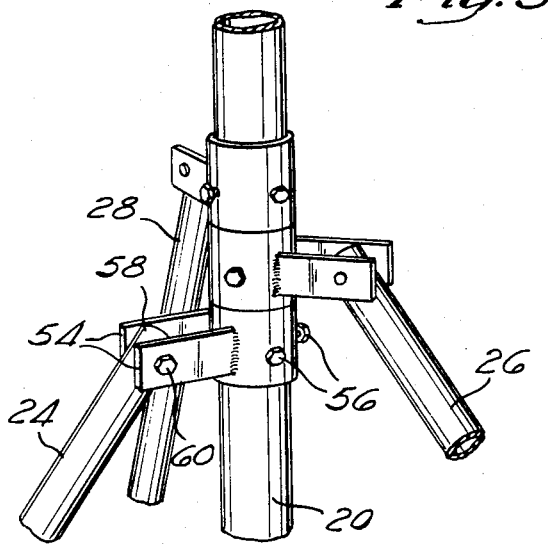
Fig. 4
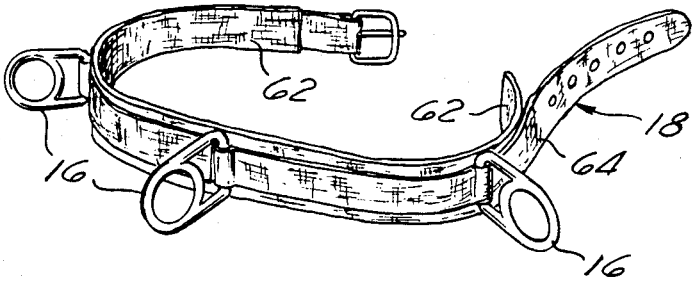
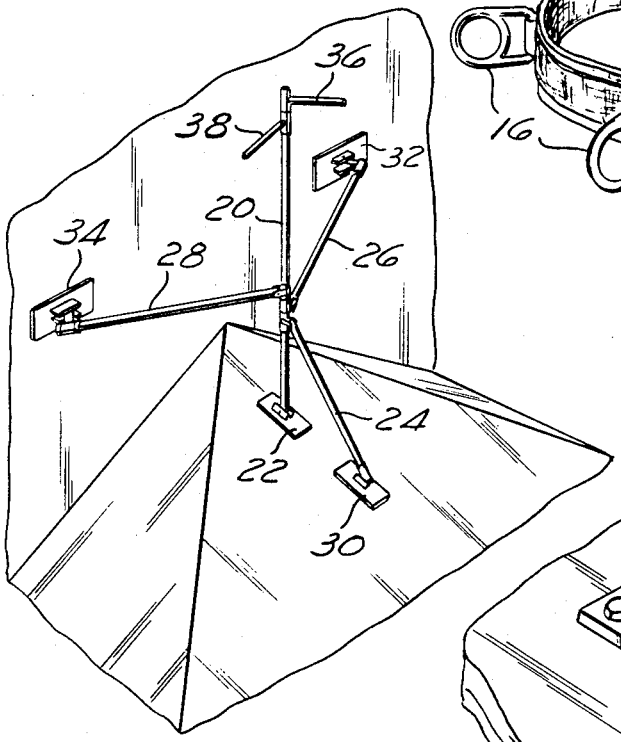
Fig. 6
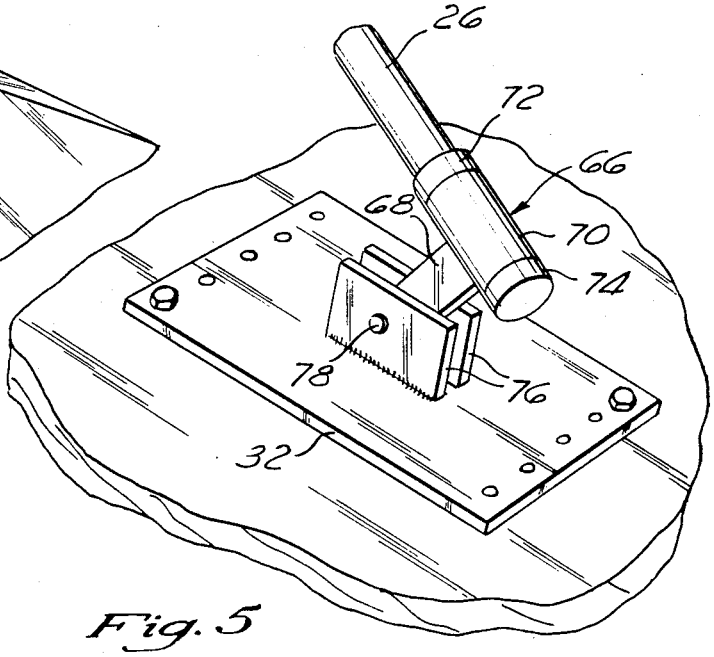
Fig. 5

ROOFING SAFETY DEVICE

BACKGROUND OF THE INVENTION

This invention relates to roofing safety devices in general, and, in particular, to self-locking anchorages.

The perils of working on rooftops are well documented. The crumbling of a roofing tile beneath the feet of a worker, or a simple stumble can result in a crippling injury or even death. For this reason, safety regulations typically require that roofing workers utilize one of various prescribed safety devices.

In general, however, roofers work without the benefit of any form of safety device. Although there are a number of reasons for this, two of the primary reasons are the cost and inconvenience of utilizing the safety devices heretofore available. Safety nets, for example, are difficult to set up and must be moved repeatedly as the workers cover the various sections of the roof. Safety rails suffer from similar shortcomings.

In an effort to provide a relatively inexpensive safety device which can be quickly and easily installed, a safety device has been developed which incorporates an upright support and a spring-loaded spool and cable safety block secured to the top thereof. The fixed end of the cable is secured to a spring-loaded spool within the block's outer housing. The free end of the cable is attached to a ring which is secured to a belt or harness, adapted to be worn by the worker. As the worker walks away from the upright support, tension on the cable will exceed the force of the spring, thereby unwinding the spool. When the worker approaches the upright support, tension on the cable will be less than the force exerted by the spring, and the spring will cause the spool to rotate, winding the cable inwardly until the tension on the cable is equal to the force of the spring. If the rate at which the cable unwinds from the spool exceeds a certain rate, corresponding to the early stages of a fall, a brake mechanism will engage, thereby preventing additional cable from unspooling and halting the movement of the worker away from the support.

The upright support of this safety device is formed by a central shaft and a pair of bracing arms. The lower end of the central shaft and each of the bracing arms is rotatably secured to a flat rectangular foot, rotatable about a horizontal axis, perpendicular to the axis of the support. The feet are adapted to be affixed to the framework of the roof, so as to secure the safety device thereto.

Unfortunately, however, use of this safety device has a number of significant drawbacks. First, the feet of the device cannot be secured to many of the wide variety of roof configurations on which the average roofer must work. Often, for example, where the roof is stepped, the feet of the device cannot be aligned with the surrounding surfaces. This is significant, because roofers, like most people, are creatures of habit, and if they become accustomed to using a safety device at all times, they will tend to always use it. If, on the other hand, they find the safety device to be difficult or impossible to install on a significant percentage of roofs, they are apt to neglect using the device even on roofs where it could be easily installed.

Secondly, even on those roofs for which the alignment of the feet with the surface of the roof is possible, the feet of the safety device can often only be aligned with the plywood sheets covering the roof, rather than the supporting beams, thereby significantly limiting the capacity of the device to bear a substantial impact. This too is a shortcoming not likely to be overlooked by the roofers. Any inconvenience for the purpose of utilizing a safety device is only likely to be endured if the workers believe that if the safety device is utilized, it will properly perform its function.

Last, but not least, the spring loaded cables of the safety device have a tendency wrap around the worker's body during use. Not only is this aggravating for the workers, but the presence of the cable can interfere with their ability to properly perform their tasks. Experience has shown this problem to be particularly acute in hot weather, when the workers are wearing less clothing and the metal cables of the safety device chafe the workers. Not surprisingly, this failing, perhaps even more than the others, leads the workers to avoid using the device and to continue the dangerous practice of working on rooftops without safety devices of any kind.

Accordingly, there is a need in the art for a roofing safety device which can be used on a wide variety of roof configurations, which will be both quick and easy to install, and be comfortable for the worker.

SUMMARY OF THE INVENTION

Briefly, the roofing safety device of the present invention comprises an upright support, adapted to be secured to the roof of a building, having at least one self-braking mechanism attached thereto. Disposed at the free end of the self-braking mechanism is a hooking device, adapted to hook onto one of a plurality of heavy rings which are firmly secured to a belt.

Advantageously, the belt includes a cushioned interior layer to promote comfort, and an outer heavy layer to enhance the strength of the belt. The heavy rings are disposed at spaced intervals along the length of the belt so as to enable the worker to select the position at which the safety device will be least cumbersome and not interfere with the task at hand.

Another significant advantage is that the safety device is adapted to be used in connection with substantially all roof configurations. This is achieved by providing a pair of stabilizing struts, each having a rectangular foot disposed at the distal end thereof. The feet are rotatable about a pair of orthogonal axes, made possible by an L-shaped spacer having a tongue portion and a cylindrical sleeve portion. The cylindrical sleeve portion is slightly larger in diameter than the strut, and therefore allows free rotation of the spacer about the strut without significant lateral movement. The tongue portion of the spacer allows rotation of the foot about a horizontal axis, perpendicular to the axis of the strut.

The enhanced diversity of the safety device, which enables it to be used on virtually all types of roofs, combined with the increased comfort provided by the belt and ring arrangement yield a product that is both convenient and easy to implement, and which therefor is more likely to be used consistently to prevent injury and death.

BRIEF DESCRIPTION OF THE DRAWINGS

These and other features of the invention will now be described with reference to drawings of a preferred embodiment which is intended to illustrate, and not to limit, the invention, and in which:

FIG. 1 perspective view illustrating the use of a roofing safety device in accordance with the principals of the present invention by two workers on a roof;

FIG. 2 is a perspective view of the roofing safety device illustrated in FIG. 1;

FIG. 3 is an enlarged perspective view illustrating the attachment of the braces to the vertical support of the roofing safety device of FIG. 2;

FIG. 4 is an enlarged perspective view of the three-ring belt of the roofing safety device of FIG. 2;

FIG. 5 is an enlarged partial perspective view illustrating the knuckle, joint pivot of the braces of the roofing safety device of FIG. 2; and FIG. 6 is a perspective view illustrating the use of the roofing safety device of FIG. 2 on an irregular rooftop.

DETAILED DESCRIPTION OF THE PREFERRED EMBODIMENT

Referring now to the drawings in detail, wherein like reference numerals designate like elements throughout the several views thereof, there is shown generally at 10 a roofing safety device embodying the present invention in a preferred form. As illustrated in FIG. 1, the roofing safety device of the present invention is adapted to be secured to a roof top, and includes at least one safety block 12 and cable 14. The cable 14 is adapted to be fastened to one of a plurality of heavy rings 16 which are secured to a belt 18 at spaced intervals. When the belt 18 is worn by a worker and connected to the safety device 10, the chances of the worker suffering a crippling fall or, more drastically, falling to his death are dramatically reduced.

As more clearly illustrated in FIG. 2, the life saving roofing safety device 10 of the present invention includes a vertical central support 20 secured to a rectangular foot 22. The support 20 is maintained in an upright position by an elongate brace 24 and a pair of stabilizing struts 26, 28. As will be discussed in greater detail below, the brace 24 is provided with a rectangular foot 30, rotatable about an axis perpendicular to the axis of the brace 24. Each strut 26, 28 is also provided with a foot 32, 34, respectively, which are rotatable about a pair of orthogonal axes. The ability of the feet 32, 34 of the struts 26, 28 to rotate about orthogonal axes is an important aspect of the invention as it permits the safety device 10 to be used in connection with the wide variety of varying roof pitches and stepped roofs which confront the roofer in today's construction environment.

The vertical support 20 provides a fixed platform 35 about which a pair of radially extending arms 36, 38 are rotatable. Each arm includes a vertically extending tubular sleeve portion 40, 42 and a radially extending arm portion 44, 46, respectively. The inner diameter of the sleeve portion is slightly larger than the outer diameter of the vertical support, so as to allow free rotation of the arms 36, 38 about the support 20, without significant lateral movement.

Secured to the outer end 48 of each radially extending arm is a safety block 12. As will be discussed in greater detail below, the safety block 12 includes a cable 14 which is secured to a spring-loaded spool (not shown). The spring-loaded spool permits the cable 14 to be unwound in response to forces sufficient to overcome the bias of the spring. When the force of the cable 14 is less than the force of the spring, the spool rotates, so as to rewind the cable, thereby preventing significant slack from forming in the cable. The safety block 12 further includes a self-braking mechanism (not shown), which stops the rotation of the spool if the rate of release of the cable exceeds a certain rate of feet per second, corresponding to the early stages of a fall.

Disposed at the free end of the cable is a fastening mechanism 50. The fastening mechanism 50 is adapted to clip onto one of three rings 16 secured to a belt 18 to be worn by the worker. The use of three rings 16, disposed at spaced intervals on the outer layer of the belt 18 is significant in that it permits the worker to secure the cable 14 to either side of his body, enabling the worker to use the device 10 without it rubbing against his body. Experience has shown that this is a highly significant aspect of the invention, in that unless the safety device is comfortable and convenient for the worker, it will generally not be used by the worker.

As best illustrated by FIG. 3, the brace 24 and struts 26, 28 are all secured to the 20 in the same manner. A cylindrical collar 52 having a pair of radially extending spacer plates 54 is rotatably secured to the support 20 by a plurality of set screws 56. The end 58 of the brace 24 opposite the foot 30 is secured between the spacer plates 54 by means of a pin 60 having an axis perpendicular to that of the spacer plates 54. Thus, the brace 24 may rotate about the support 20 when the set screws 57 are loosened, and may also pivot about the pin 60.

An exemplary belt 18 utilized with the roofing safety device 10 of the present invention is illustrated in FIG. 4. The belt 18 permits the worker to attach the cable 14 of the safety block 12 to either side of his body, thereby allowing the worker to perform his task on the roof without being chafed by the cable. Advantageously, the belt 18 is double layered, having an interior layer 62 which is cushioned to promote the comfort of the wearer, and an outer heavy layer 64 to enhance the strength of the belt 18. Three heavy rings 16 are firmly secured to the outer layer 64 of the belt 18 at spaced intervals, corresponding to the hips of the wearer and the small of the wearer's back. It would be possible, of course, to utilize a belt with a single ring to slide about the wearer to permit the worker to utilize the belt without being chafed by the cable of the safety block.

The ability of the safety device 10 to be used in connection with virtually all roof configurations is important not only in that it permits the safety device to be used on a greater variety of roofs, but in that it permits the roofer to become accustomed to always working with the safety device, thereby strongly increasing the likelihood that the use of the safety device will become habitual, eventually resulting in fewer roofing injuries and deaths. The aspect of the invention which permits the safety device 10 to be used on a stepped roof is the use of the two struts 26, 28 having feet 32, 34 with the ability to rotate about a pair of orthogonal axes. This rotation is permitted by a generally L-shaped spacer 66 including a tongue portion 68 and a cylindrical sleeve portion 70. The sleeve portion 70 has an inner diameter slightly larger than the outer diameter of the strut, thereby permitting the free rotation of the spacer 66 about the strut without significant lateral movement. The sleeve portion 70 is prevented from moving axially along the strut by two raised cylindrical rings 72, 74, fixed to the strut axially adjacent either end of the sleeve portion of the spacer.

The tongue portion 68 of the spacer 66 extends radially outward from the sleeve portion 70 and is secured between a pair of raised spacer plates 76 extending perpendicularly upward from the foot of the strut by a pin 78. The tongue portion 68 of the spacer 66 allows rotation of the foot about a horizontal axis, perpendicular to the axis of the strut.

FIG. 6 illustrates the ability of the roofing safety device 10 of the present invention to be used in connection with an irregular rooftop. The foot 22 of the vertical support 20 is aligned with a surface of the roof, preferably over a support beam. The brace 24 is then secured to the roof in a similar manner. Because the feet 32, 34 of the struts 26, 28 are rotatable about a pair of orthogonal axes, it is possible to position the struts in a number of various configurations. As depicted in FIG. 6, the struts 26, 28 may be secured to a wall or even to exceptionally steep rooftops, a feature not provided by the prior art. The enhanced ability of the roofing safety device to conform to substantially any roofing configuration, coupled with the increased comfort provided by the belt and ring arrangement strongly increases the likelihood that use of the safety device of the present invention will become habitual so as to reduce the number of roofing injuries and deaths.

It will be appreciated that certain structural variations may suggest themselves to those skilled in the art. The foregoing detailed description is to be clearly understood as given by way of illustration, the spirit and scope of this invention being limited solely by the appended claims.

What is claimed is:

1. A roofing safety device, comprising:

an axially elongate support member having a first end and a second end;

an axially elongate brace having an inner end and an outer end, said inner end of said brace secured to said support, intermediate said first and second ends;

first and second rectangular base members, secured to said second end of said support and said outer end of said brace, respectively, said base members securable to a roof;

a pair of stabilizing struts, each having an inner end and an outer end, said struts secured to said support member, adjacent said brace, intermediate said first and second ends of said support;

a pair of rectangular feet secured to said outer ends of said struts, respectively, said feet being rotatable about a pair of non-parallel axes and securable to a roof or adjacent surface; and at least one self-braking safety mechanism, mounted to said first end of said support, said safety mechanism adapted to attach to a roof worker so as to prevent said worker from falling off said roof.

2. A roofing safety device, as defined by claim 1, wherein said brace and said struts are each secured to a collar which is rotatable about said vertical support, each of said collars securable to said support so as to stop said rotation by a plurality of set screws.

3. A roofing safety device, as defined by claim 1, further comprising:

a pair of L-shaped spacers, secured to said outer ends of said struts, respectively, each of said spacers having a cylindrical sleeve portion, rotatable about said strut, and a tongue portion, extending radially outwardly from said sleeve portion, said tongue portion secured between a pair of raised plates, extending perpendicularly upward from each of said feet, said tongue portion allowing said foot to rotate about said about an axis perpendicular to the axis of said strut.

4. A roofing safety device, as defined by claim 1, further comprising:

a belt, adapted to be worn by a worker; and means for attaching said safety device to said belt at various locations to avert chafing of the worker by said device.

5. A roofing safety device, as defined by claim 4, wherein said means for attaching comprises a plurality of annular couplings, secured to said belt at spaced intervals corresponding to the hips of the worker and the small of the worker's back, so as to allow the worker to select the optimal location at which the safety device is to be secured.

6. A roofing safety device, as defined by claim 4, wherein said belt has a cushioned interior layer to promote comfort and a heavy outer layer to enhance strength.

7. A roofing safety device, as defined by claim 1, wherein said safety mechanism is attached to an arm which extends radially outwardly from said first end of said support, said arm being rotatable about said support, so as to prevent said safety mechanism from wrapping around the body of the worker.

* * * * *

UNITED STATES PATENT AND TRADEMARK OFFICE

CERTIFICATE OF CORRECTION

PATENT NO. : 4,852,692

DATED : August 1, 1989

INVENTOR(S) : Brian J. Flaherty

It is certified that error appears in the above-identified patent and that said Letters Patent is hereby corrected as shown below:

Column 2, line 66, change "perspective view" to --is a perspective view--

Column 4, line 14, change "20 in" to --vertical support 20 in--

Column 6, line 20, change "rotate about said about" to --rotate about an--

Signed and Sealed this

Seventeenth Day of September, 1991

*Attest:*

HARRY F. MANBECK, JR.

*Attesting Officer*

*Commissioner of Patents and Trademarks*